United States Patent [19]

Ajmera

[11] Patent Number: 4,522,301

[45] Date of Patent: Jun. 11, 1985

[54] TRAY

[75] Inventor: Shreyas H. Ajmera, Downsview, Canada

[73] Assignee: Baker's Bakery Ltd., Downsview, Canada

[21] Appl. No.: 621,257

[22] Filed: Jun. 15, 1984

[51] Int. Cl.[3] ..... B65D 21/04

[52] U.S. Cl. ..... 206/507; 229/2.5 R; 426/119; 426/130; 426/389; 217/26.5; 220/23.6

[58] Field of Search ..... 206/507, 503, 509, 511; 220/23.6; 426/119, 130, 389; 229/2.5 R; 217/26.5

[56] References Cited

U.S. PATENT DOCUMENTS

| | | | |
|---|---|---|---|
| 3,197,058 | 7/1965 | Hale | 206/507 |
| 3,219,231 | 11/1965 | Hart et al. | 206/507 |
| 3,469,686 | 9/1969 | Gutsche et al. | 220/23.6 |
| 3,809,236 | 5/1974 | Davis et al. | 220/23.6 |
| 3,896,239 | 7/1975 | Peters | 206/507 |
| 3,982,655 | 9/1976 | Kaupert | 220/23.6 |
| 3,989,154 | 11/1976 | Walklet | 220/23.6 |
| 3,997,057 | 12/1976 | Craig | 206/507 |
| 4,101,049 | 7/1978 | Wallace et al. | 206/507 |
| 4,256,224 | 3/1981 | Hirota | 206/507 |

FOREIGN PATENT DOCUMENTS

| | | | |
|---|---|---|---|
| 2730334 | 1/1978 | Fed. Rep. of Germany | 206/507 |

*Primary Examiner*—Joseph Man-Fu Moy
*Attorney, Agent, or Firm*—Ivor M. Hughes

[57] ABSTRACT

Improved tray, suitable for packaging croissants.

4 Claims, 11 Drawing Figures

TRAY

FIELD OF INVENTION

This invention relates to improvements in trays suitable for packaging croissants.

BACKGROUND OF INVENTION

Croissants as a commestible have become extremely popular. However, they are time consuming to prepare as the dough must be prepared, kneaded, cut and rolled up, permitted to rise and finally baked. In an attempt to reduce the preparation time by the ultimate seller of the baked product to the consumer (whether at a restaurant or local bakery), large bakeries have mass produced the dough, cut the dough into the desired shape, rolled the dough up into the croissant in a substantially flat or straight form, then packaged and frozen the dough. The forms were usually packed, prior to freezing, by placing them in multiple layers on waxed paper in a flat box prior to freezing, then frozen and shipped. The drawback with this prior art proposal has been the amount of time involved in the process of thawing and reshaping the forms. In particular, an interval of time after the forms have thawed is necessary to permit the dough to regain its elasticity so that it may be manually bent into the normal crescent shape of croissant.

In a more recent approach, the rolled dough forms are placed in annular recesses of a tray, stretched about a central raised stem and then frozen. The dealer, upon receiving the frozen dough, will then remove the frozen forms from the annular recesses in the tray and arrange them on a baking sheet where they will be permitted to thaw and proof without requiring further shaping to conform to the normal crescent shape of croissant. Normally, where such a tray is employed, one tray may not be surmounted on another tray for packaging a stack of such trays since an annular recess presenting a mouth on one side of the tray will present a protuberance on the other side of the tray which will extend into the mouth of an annular recess presented by an underlying tray, deforming the croissant dough contained in the annular recess. Normally this is the case where for example, each tray has a plurality of similarly spaced annular recesses such that when one tray is superimposed on another, similarly spaced protuberances will align with identically spaced recesses of the underlying tray. While this drawback may be overcome, for example by irregularly spacing the plurality of annular recesses in each tray and orienting stacked trays 180 degrees with respect to one another, such a solution does not permit the maximum use of the area of the tray for annular recesses, since a portion of the top surface area of an underlying tray would be devoted to supporting the protuberances of an overlying tray.

It is therefore an object of this invention to provide an improved tray suitable for use in carrying croissant dough and for packaging a plurality of such trays stacked one on the other.

Further and other aspects of the invention will be realized by those skilled in the art from the following summary of the invention and detailed description of an embodiment thereof.

SUMMARY OF INVENTION

According to one aspect of the invention, an improved tray carrying a plurality of spaced apart recesses, suitable for carrying a plurality of forms of raw croissant dough, of a design and configuration permitting a plurality of such trays to be stacked one on the other without deforming the forms of raw croissant dough carried in such recesses is provided, the improvement comprising a specially configured tray carrying a plurality of similarly spaced apart cavities, each cavity having a mouth substantially coplanar with the plane of the top of the tray, an inclined base to carry the fatter portion of the croissant in the deeper portion of the base, a peripheral wall defining the vertical space between the mouth and the inclined base of each cavity, and a raised portion raised from the shallower portion of the inclined base and extending from the peripheral wall. According to this aspect of the invention the croissant resting within a cavity reaches not higher than the plane of the mouth of the cavity and not higher than the plane of the raised portion raised from the inclined base. According to this aspect of the invention, each cavity presents an inclined protuberance on the underside of the tray, whereby at least two trays stacked one on the other may be oriented 180 degrees with respect to each other so as to align the deeper portion of each protuberance to rest upon the raised portion raised from the inclined base of a cavity of an underlying tray. It will be appreciated that such a configuration permits the most efficient use of the available surface area of each tray permitting the plurality of cavities to be substantially closely spaced while still allowing trays to be stacked without deforming croissant dough contained in the cavities.

According to a further aspect of the invention, similarly oriented trays may be nested one on the other such that similarly spaced protuberances will align with identically spaced recesses of an underlying tray to permit compact nesting of empty trays.

According to a preferred embodiment of the invention, each cavity having a mouth substantially within the plane of the tray comprises a substantially semi-circular shaped cavity having a substantially semi-circular shaped peripheral wall and a wall forming a diameter for the substantially semi-circular wall, an inclined base or bottom, inclined relative to the plane of the tray from a position spaced from the plane of the tray proximate the diameter to a position further spaced from the plane of the tray proximate the semi-circular shaped peripheral wall remote the diameter at an angle of preferably about 20 degrees declining away from the plane of the tray and, a raised portion preferably comprising a mushroom shaped raised portion raised from the base comprising a stem extending from the diameter towards the peripheral semi-circular portion remote the diameter, and a cap on the end of the stem spaced from the diameter providing a pair of recesses on either side of the stem between the cap and the diameter into which the ends of croissant dough may be positioned.

According to a preferred embodiment of the invention, an improved molded plastic tray, preferably thermally vacuum formed, is provided (preferably the tray having a length of about 18" (46 cm), width of about 14" (36 cm), and a depth of about 1¼" (3 cm), carrying a plurality of similarly spaced apart molded cavities (in this embodiment 16) depending from the plane of the tray. The cavities are each preferably substantially semi-circular depressions having a diameter of approximately 4 inches (10 cm), a radius of approximately 3 inches (8 cm), and a base declined at an angle of approximately 20 degrees to the surface of the tray, with the deepest portion of the cavity equal to 1¼" (3 cm) proximate that portion of the semi-circular peripheral wall remote the diameter. The central part of the base proximate the diameter carries a raised mushroom shape comprising a stem extending from a central portion of the diameter and a cap spaced from the diameter providing a recess on either side of the stem, the cap for positioning croissant in the cavity to be stretched about the cap to define the croissant's crescent shape, the stem for supporting the inclined protuberance of an overlying tray presented by the inclined base of the cavities of such overlying tray proximate the deepest portion of each cavity at a position proximate the semi-circular shaped peripheral wall. The result is that when raw croissant dough is placed in the circular recesses of a tray it may be stretched about the raised cap to provide the desired crescent shape, the crescent shape of the dough substantially fitting inside the inclined cavity such that it is substantially flush with the plane of the mouth of each cavity. Trays containing croissant may be stacked one on the other by orienting each tray 180 degrees (in the plane of the tray) to another, permitting such stacking without deforming the raw croissant. Trays containing croissant may then be frozen and shipped to the customer. When the frozen croissants are "popped" out of the tray, they have the desired uniform crescent shape and it is not necessary to wait for the dough to regain its elasticity so that it may be manually bent into the normal crescent shape of croissant.

The invention will now be described with reference to drawings of an embodiment thereof.

DETAILED DESCRIPTION OF THE DRAWINGS

Figure 1:
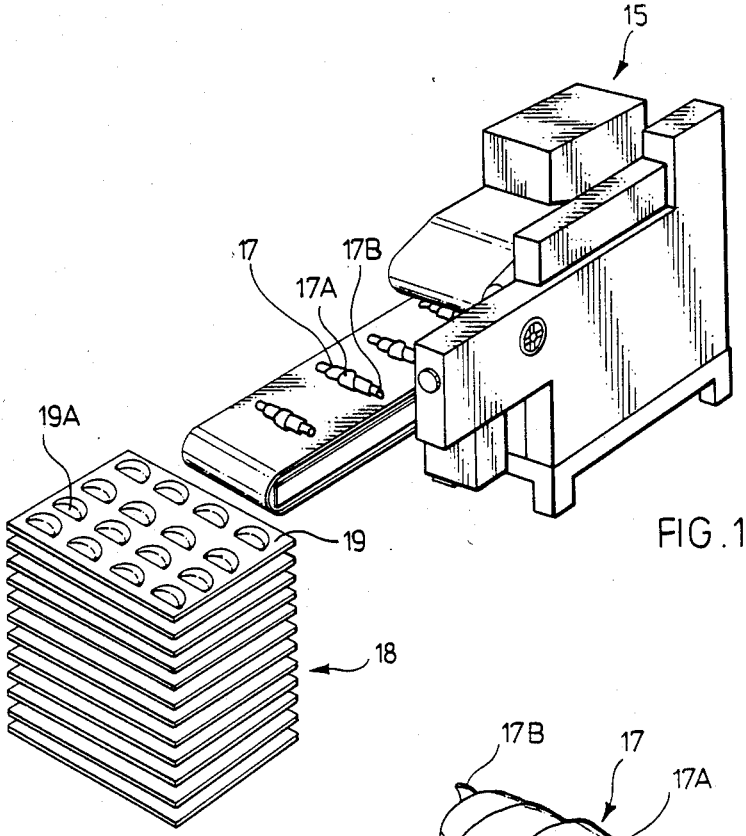
FIG. 1 is a perspective view of a machine used for making croissants each having a fattened centre and tapered ends, and a stack of trays into which the croissants are deposited according to an embodiment of the invention.
Figure 2:
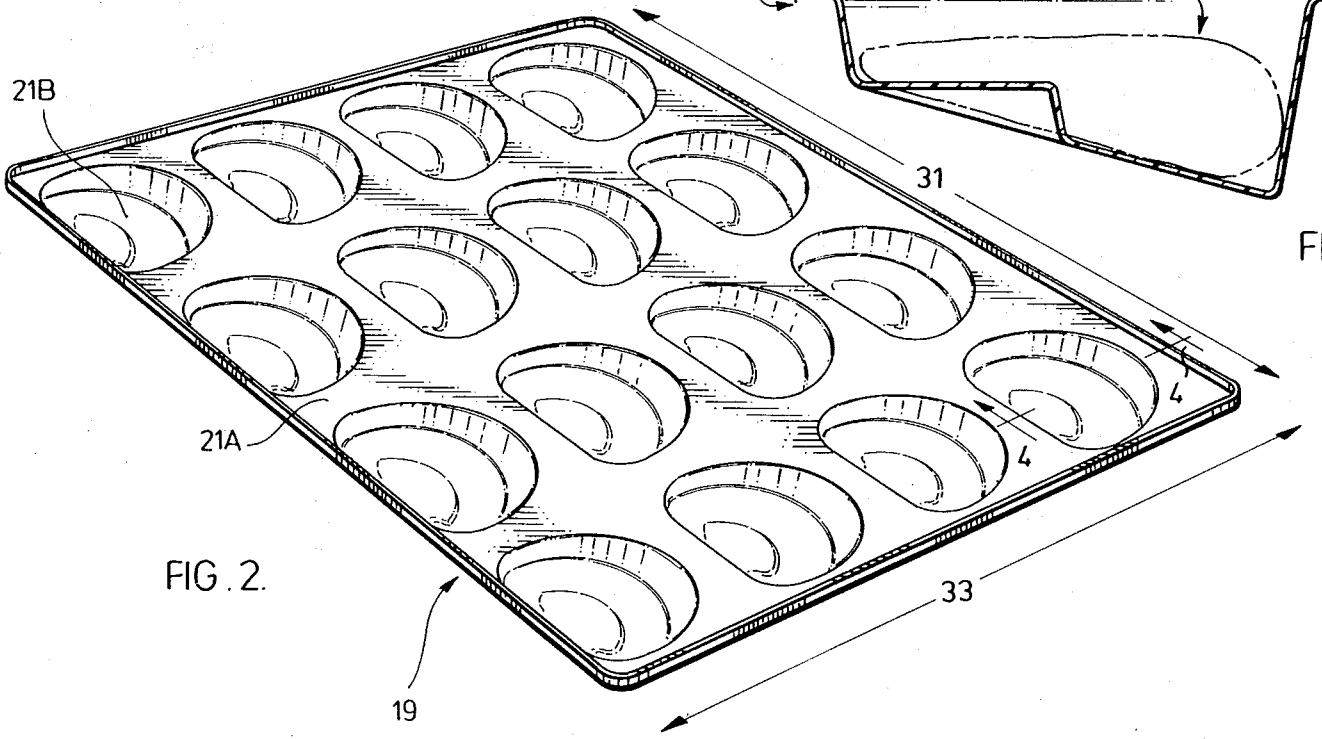
FIG. 2 (shown with FIG. 4) is a perspective view of one of the trays shown in FIG. 1.

With reference to FIG. 1, there is shown a croissant forming machine 15 used to mechanically cut rectangular sheets of croissant pastry dough in flat isosceles triangles of raw dough (with yeast) and roll them up to rolled croissant dough 17 (shown best in FIG. 3) with a fat centre 17A and tapered ends 17B. A stack of trays 18 comprising trays 19, one of which is shown in FIG. 2, are provided beside machine 15 for receipt of the formed croissants, one croissant for each cavity shown in 21.

Figure 3:
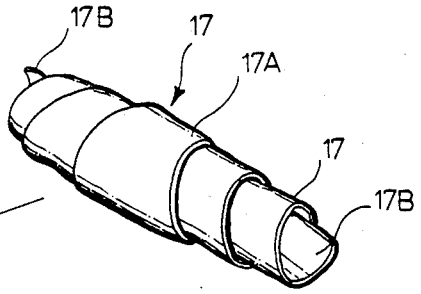
FIG. 3 (shown with FIG. 1) is a perspective view of one of the cavities of the tray shown in FIG. 2 and a raw croissant ready for depositing into the cavity according to an embodiment of the invention.
Figure 3:
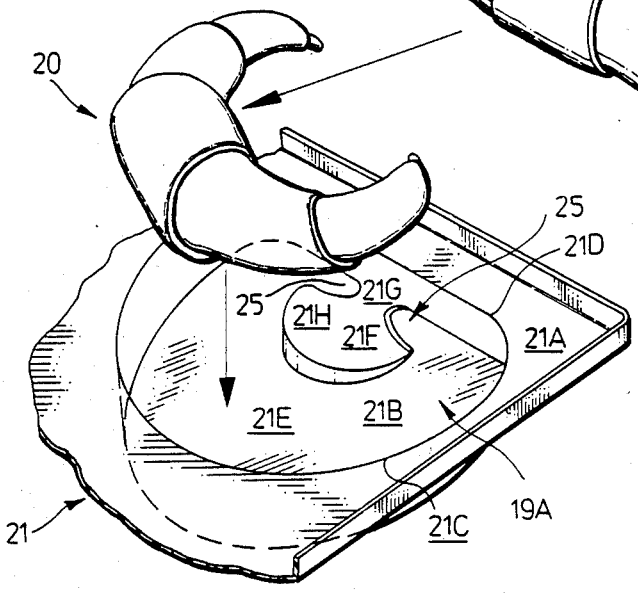

With reference to FIG. 3, rolled croissant dough 17 is bent by hand into a crescent shape 20 and placed into cavity 21. Cavity 21, comprising one of 16 like cavities 21, is secured to the plane 21A of the top of tray 19, and has mouth 21B coplanar with the plane 21A of the top of tray 19. Each cavity 21 is substantially semi-circular in shape housing a substantially semi-circular shaped peripheral wall 21C and wall 21D forming a diameter for substantially semi-circular wall 21C and has an inclined base 21E (See FIGS. 4 and 7) inclined at an angle of substantially 20 degrees to the plane of the tray away from the tray in a direction looking from wall 21D to a position on wall 21C remote wall 21D. Mushroom shaped spacer 21F spaced from base 21E is secured to wall 21D comprises stem 21G extending from 21D to cap 21H on the end of stem 21G spaced from wall 21D providing a pair of recesses 25 into which recesses 25 the ends 17B of croissant 17 are placed when formed into the shape shown as 20 (See FIG. 2).

Cavity 21 is of such volume relative to raw croissant 17 (in an unrisen state) that croissant 17 when it rises to a volume not more than ⅔ of its volume when it has fully risen, substantially fills the volume of cavity 21 to mouth 21B, while tapered ends 17B of rolled croissant dough 17 fill volume of cavity 21 proximate wall 21D not higher than raised stem 21G.

When rolled croissant dough 17 is inserted into cavity 21, croissant is bent about mushroom shaped spacer 21F to provide the desired crescent shape and tips 17B of the croissant are stretched and inserted into recesses 25 flush with the plane of stem 21G.

Figure 6:
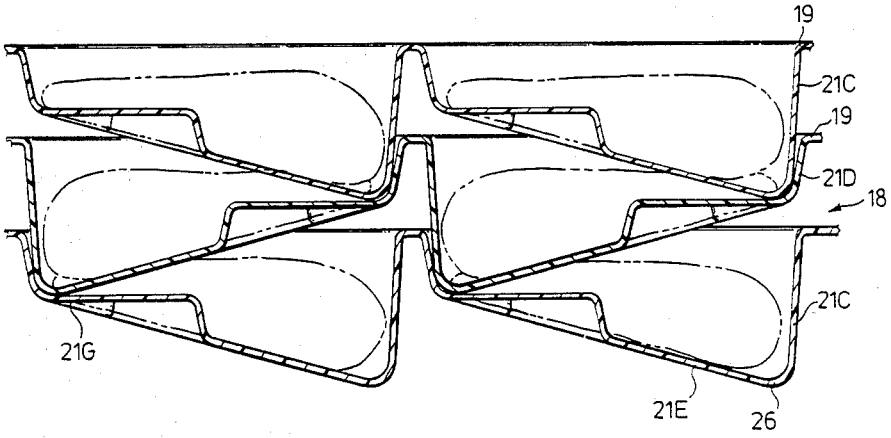
FIG. 6 is a cross-sectional view of a plurality of cavities (each cavity comprising part of a tray) shown containing raw croissant (as in FIG. 4), each cavity oppositely aligned and stacked one on the other.
Figure 7:
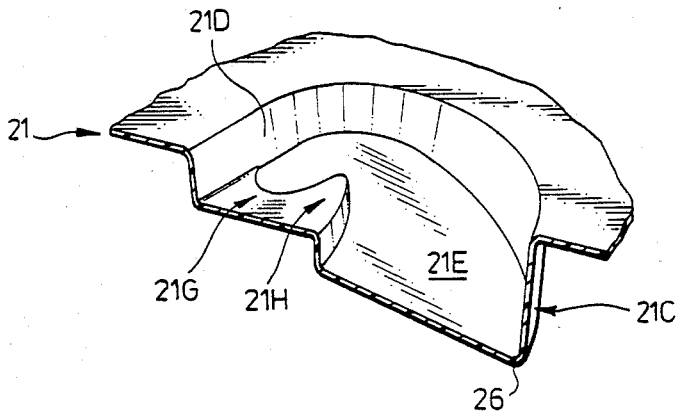
FIG. 7 is a perspective cross-sectional side view through the cavity (without raw croissant) shown in FIG. 2.
Figure 8:
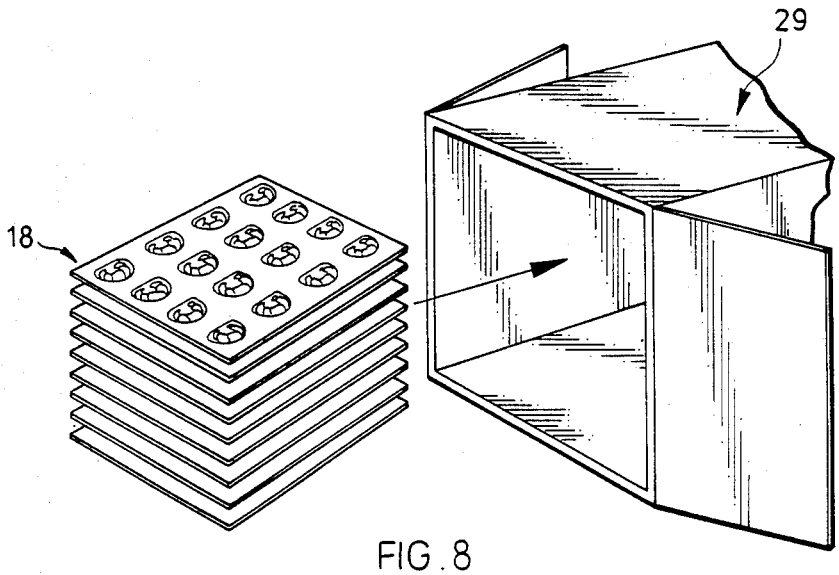
FIG. 8 (found with FIG. 7), 9, 10 and 11 illustrates steps to be taken to process raw croissants packaged according to an embodiment of the invention.

With reference to FIGS. 6, 7 and 8, a stack of trays 18 is shown, comprising trays 19 containing croissant 17 stacked one on the other by orienting peripheral wall 21C of one tray proximate wall 21D of an underlying tray 19. The result is that portion 26 of base 21E proximate peripheral wall 21C rests upon the surface area of stem 21G only, permitting such stacking without deforming croissant 17.

With reference to FIG. 8, the stack 18 of trays 19 containing croissant dough are packed in a box 29 and frozen. The frozen croissant are then ready for delivery to, for example, a bakery or restaurant for final processing prior to sale or service to a customer.

Figure 9:
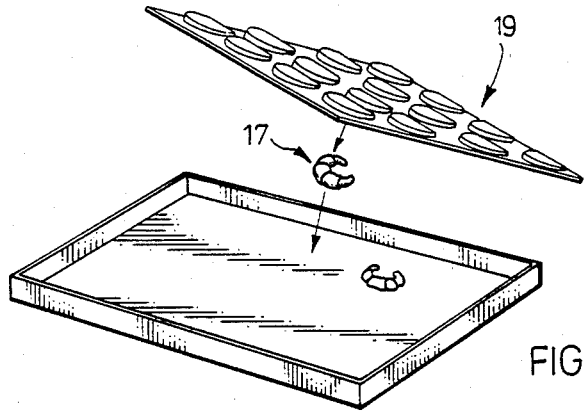
Figure 10:
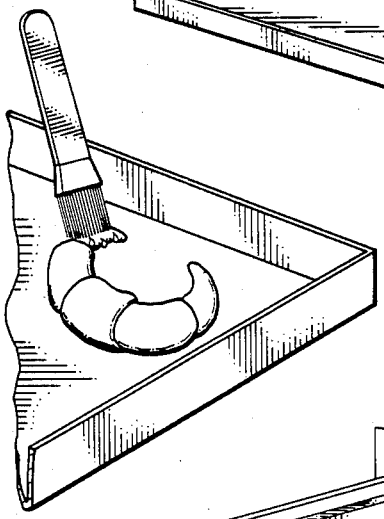
Figure 11:
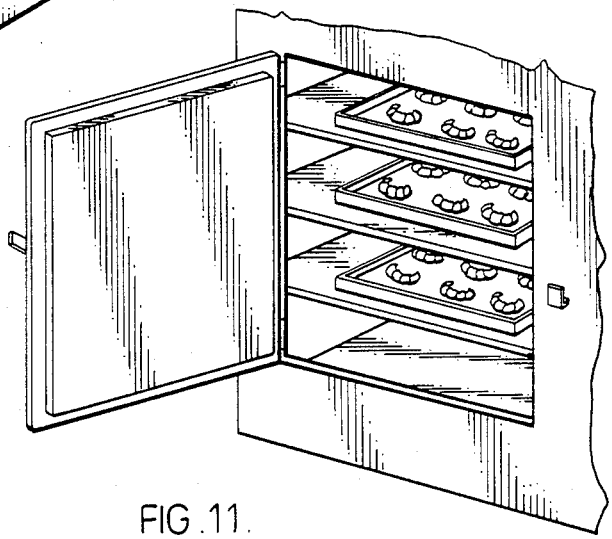

With reference to FIG. 8, 9 and 10, a dealer receiving the trays of frozen croissants, pops them out of tray 19 and without further manual shaping permits them to thaw (about 1 hour). With reference to FIG. 9, each thawed croissant 17 is egg washed, then permitted to rise fully (another 15 minutes) and then baked (See FIG. 11) in oven.

Figure 4:
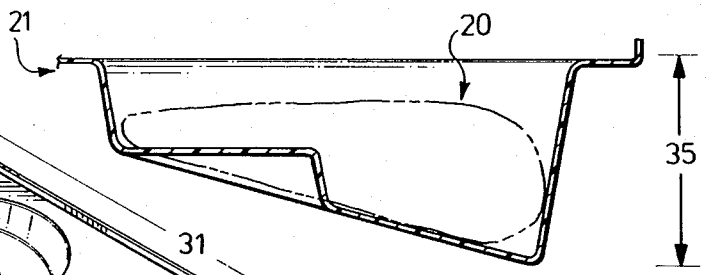
FIG. 4 (shown with FIG. 2) is a cross-sectional view of the cavity taken along line 4—4 shown in FIG. 2, shown containing a raw croissant, according to an embodiment of the invention.

With reference to FIGS. 2 and 4, molded plastic tray 19 is provided having a length 31 of 18" (46 cm), width 33 of 14" (36 cm) and maximum depth 35 of 1¼" (3 cm). Wall 21D has a depth of ½" (1 cm) extending to depth of wall 21C of 1¼" (3 cm). Base 21E is angled at 20 degrees to the plane 21A of tray 19 sloping away from plane 21A from wall 21D to the portion of wall 21C remote wall 21D.

Figure 5:
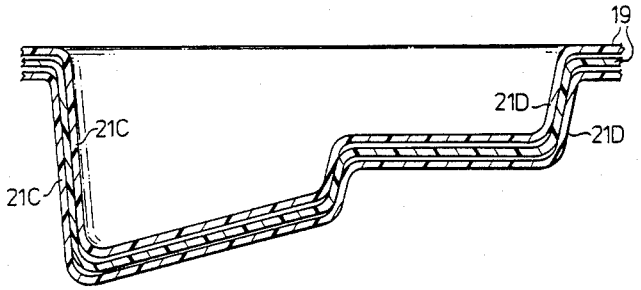
FIG. 5 is a cross-sectional view of a plurality of cavities, each cavity comprising part of a tray (shown in FIG. 2), similarly aligned and stacked to permit compact nesting of empty trays.

With reference to FIG. 5, similarly oriented trays 19 may be nested one on the other for storage by orienting peripheral wall 21C of one tray proximate wall 21C of an adjacent tray thereby aligning the entire configuration of cavity 21 so as to permit compact nesting of empty trays.

As many changes can be made to the embodiment without departing from the scope of the invention, it is intended that all matter contained herein shall be interpreted as illustrative of the invention and not in a limiting sense.

The embodiments of the invention in which an exclusive property or privilege is claimed are as follows:

1. An improved tray carrying a plurality of spaced apart recesses, suitable for carrying a plurality of forms of raw croissant dough, of a design and configuration permitting a plurality of such trays to be stacked one on the other without deforming the forms of raw croissant dough carried in such recesses is provided, the improvement comprising a specially configured tray carrying a plurality of similarly spaced apart cavities, each cavity having a mouth substantially coplanar with the plane of the top of the tray, an inclined base to carry the fatter portion of the croissant in the deeper portion of the base, a peripheral wall defining the vertical space between the mouth and the inclined base of each cavity, and a raised portion raised from the shallower portion of the inclined base and extending from the peripheral wall, of suitable dimensions such that normally a croissant resting within a cavity reaches not higher than the plane of the mouth of the cavity and not higher than the plane of the raised portion raised from the inclined base, and, each cavity presents an inclined protuberance on the underside of the tray whereby at least two trays stacked one on the other may be oriented 180 degrees with respect to each other so as to align the deeper portion of each protuberance to rest upon the raised portion raised from the inclined base of a cavity of an underlying tray.

2. The improved tray of claim 1, whereby similarly oriented trays may be nested one on the other such that similarly spaced protuberances will align with identically spaced recesses of an underlying tray to permit compact nesting of empty trays.

3. The improved tray of claim 1, whereby each cavity having a mouth substantially coplanar with the plane of the top of the tray comprises a substantially semi-circular shaped cavity having a substantially semi-circular shaped peripheral wall and a wall forming a diameter for the substantially semi-circular wall, an inclined base or bottom, inclined relative to the plane of the tray from a position spaced from the plane of the tray proximate the diameter to a position further spaced from the plane of the tray proximate the semi-circular shaped peripheral wall remote the diameter at an angle of preferably about 20 degrees declining away from the plane of the tray and, a raised portion preferably comprising a mushroom shaped raised portion raised from the base comprising a stem extending from the diameter towards the peripheral semi-circular portion remote the diameter, and a cap on the end of the stem spaced from the diameter providing a pair of recesses on either side of the stem between the cap and the diameter into which the ends of croissant dough may be positioned.

4. A preferred embodiment of the improved tray of claim 3, whereby the improved molded plastic tray, preferably thermally vacuum formed, comprises dimensions having a length of about 18" (46 cm), width of about 14" (36 cm), and a depth of about 1¼" (3 cm), and the plurality of similarly spaced apart substantially semi-circular cavities (in this embodiment 16) depending from the plane of the tray, each preferably have a diameter of approximately 4 inches (10 cm) a radius of approximately 3 inches (8 cm), and a base declined at an angle of approximately 20 degrees to the plane of the top of the tray, with the deepest portion of the cavity equal to 1¼" (3 cm) proximate that portion of the semi-circular pheripheral wall remote the diameter.

* * * * *